US009242254B2

(12) United States Patent
Zhou et al.

(10) Patent No.: US 9,242,254 B2
(45) Date of Patent: Jan. 26, 2016

(54) MULTI FUNCTION OUTLET MECHANISM

(75) Inventors: Huasong Zhou, Xiamen (CN); Hongliang Ma, Xiamen (CN); Xijie Deng, Xiamen (CN); Zhongcheng Jin, Fujian (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 321 days.

(21) Appl. No.: 13/877,658

(22) PCT Filed: Sep. 30, 2011

(86) PCT No.: PCT/CN2011/080406

§ 371 (c)(1), (2), (4) Date: Apr. 3, 2013

(87) PCT Pub. No.: WO2012/045268

PCT Pub. Date: Apr. 12, 2012

(65) Prior Publication Data

US 2013/0199641 A1 Aug. 8, 2013

(30) Foreign Application Priority Data

Oct. 8, 2010 (CN) ..... 2010 1 0500197
Oct. 8, 2010 (CN) ..... 2010 2 0552963 U

(51) Int. Cl.

*B05B 1/16* (2006.01)
*B05B 1/18* (2006.01)
*B05B 3/04* (2006.01)

(52) U.S. Cl.

CPC ..... *B05B 1/1609* (2013.01); *B05B 1/1654* (2013.01); *B05B 1/18* (2013.01); *B05B 3/04* (2013.01); *Y10T 137/86485* (2015.04)

(58) Field of Classification Search

CPC ..... B05B 1/185; B05B 1/18; B05B 1/1654; B05B 1/1609; B05B 3/04; Y10T 137/86485

USPC ..... 239/436–449, 383

See application file for complete search history.

(56) References Cited

U.S. PATENT DOCUMENTS 3,958,756 A * 5/1976 Trenary et al. ..... 239/381
4,398,669 A * 8/1983 Fienhold ..... 239/447

(Continued)

FOREIGN PATENT DOCUMENTS

CN 201040267 Y 3/2008
CN 201205529 Y 3/2009

(Continued)

*Primary Examiner* — Arthur O Hall
*Assistant Examiner* — Juan C Barrera
(74) *Attorney, Agent, or Firm* — Rabin & Berdo, P.C.

(57) ABSTRACT

A multi function outlet mechanism comprises the main body unit, the switch mechanism and the control mechanism. The main body unit comprises an inlet waterway, two outlet waterways and an outlet terminal, the outlet terminal is provided with a plurality of water division cavities, and the check valves are arranged in at least two water division cavities, and the first outlet waterway is communicated with a plurality of check valves, when the water pressure of the first outlet waterway is bigger than the control water pressure of the check valves, the check valves are opened, water flows into the water division cavities from the first outlet waterway. The switch mechanism and the control mechanism are mounted in the main body unit, the users can use the switch mechanism to control at least the first outlet waterway and the second outlet waterway communicating with the inlet waterway in a switching manner.

13 Claims, 7 Drawing Sheets

(56) References Cited

U.S. PATENT DOCUMENTS

| | | | | |
|---|---|---|---|---|
| 4,588,130 | A | 5/1986 | Trenary et al. | |
| 5,862,985 | A * | 1/1999 | Neibrook et al. | 239/99 |
| 6,076,743 | A | 6/2000 | Fan | |
| 6,412,711 | B1 * | 7/2002 | Fan | 239/446 |
| 2006/0261191 | A1 | 11/2006 | Chang | |
| 2008/0272203 | A1 * | 11/2008 | Leber | 239/101 |
| 2009/0124946 | A1 * | 5/2009 | Zhadanov et al. | 601/169 |

FOREIGN PATENT DOCUMENTS

| | | | |
|---|---|---|---|
| CN | 101761671 | A | 6/2010 |
| CN | 102091677 | A | 6/2011 |
| JP | 08-004068 | A | 1/1996 |

* cited by examiner

MULTI FUNCTION OUTLET MECHANISM

FIELD OF THE INVENTION

The present invention relates to a bathroom equipment, more particular to a multi function outlet mechanism in bathroom.

BACKGROUND OF THE INVENTION

The outlet shower in the present market comprises a fixed unit and a switch mechanism. The fixed unit is provided with a plurality of water division cavities and an inlet waterway, and each water division cavity is provided with a corresponding outlet face cover region. The switch mechanism is mounted in the fixed unit, so that the users can control the switch mechanism and then a plurality of water division cavities can be communicated with the inlet waterway. Because each water division cavity is provided with a corresponding outlet face cover region, water can only comes out of the corresponding outlet face cover region at each switch, and water cannot comes out of multi outlet face cover regions at the same time, and the outlet area is small, and some places that needs to be modified are present.

SUMMARY OF THE INVENTION

The object of the present invention is to offer a multi function outlet mechanism which overcomes the defect of the outlet shower at the prior.

The technical proposal solving the technical matter in the present invention is:

Multi function outlet mechanism, comprises:

A main body unit, which is provided with an inlet waterway, a first outlet waterway, a second outlet waterway and an outlet terminal, the outlet terminal is provided with a plurality of water division cavities, and check valves are arranged in at least two water division cavities, and the first outlet waterway is communicated with the check valves, when the water pressure of the first outlet waterway is bigger than the control water pressure of the check valves, the check valves are opened, water flows into the water division cavities from the first outlet waterway;

A switch mechanism, which is mounted to the main body unit, the users can use the switch mechanism to control at least one of the first outlet waterway and the second outlet waterway communicating with the inlet waterway in a switching manner; and A control mechanism, which is mounted at the main body unit, so that the second outlet waterway can communicated with a plurality of the water division cavities in a switching manner.

In a preferred embodiment, the control mechanism comprises:

An outlet cavity, which is communicated with the second outlet waterway, and water division holes are arranged on the undersurface of the outlet cavity, the number of which is equal to the water division cavities with check valve, and the water division holes and the water division cavities are communicating respectively;

A switch plate, in which the penetrating hole corresponding to the water division holes and penetrating up and down is arranged, and the switch plate is mounted on the undersurface of the outlet cavity in a sealing and rotating manner;

And an impeller, which is connected to the switch plate in a transmission manner, and is pivotally connected in the outlet cavity and can rotate with respect to the main body unit under the impact of the water flow of the second outlet waterway, and the impeller can drive the switch plate rotate, and the penetrating hole can communicate with a is plurality of the water division holes in a switch manner.

In a preferred embodiment, a reducing mechanism is connected between the impeller and the switch plate.

In a preferred embodiment, the reducing mechanism comprises an inner gear arranged in the outlet cavity and an outer gear arranged in the outlet cavity in a rotating manner, the inner gear is meshed with the outer gear, and the tooth numbers of the inner gear and the outer gear are not the same, and a synchronous rotary connection relationship is formed between the outer gear and the impeller and between the outer gear and the switch plate.

In a preferred embodiment, the switch mechanism is a rotary switch mechanism.

In a preferred embodiment, the outlet terminal comprises a face cover and a water division plate, the face cover and the water division plate are fixed together and forms a plurality of independent water division cavities, mounting holes arranged in a circle are arranged on the water division plate, the number of which is equal to the water division cavities with check valves, the mounting holes are used for mounting the check valve; the outlet holes arranged in a circle are arranged on the water division plate, the number of which is equal to the water division cavities with check valve; the diameter of the circle of the mounting holes is larger than the diameter of the circle of the outlet holes.

In a preferred embodiment, the control mechanism is used for communicating a plurality of the outlet holes with the second outlet waterway in a switch manner.

In a preferred embodiment, the main body unit also comprises a circular waterproof plate and a fixing piece, the outlet terminal is connected to the fixing piece in a rotating manner, and the waterproof plate is fixed on the water division plate of the outlet terminal to form a circular first outlet waterway corresponding to the check valves; the outlet holes of the water division plate is located in the inner bore of the waterproof plate; the switch mechanism comprises a communicating hole that is opened on the waterproof plate and communicating with the first outlet waterway, the communicating hole is communicating with the inlet waterway when the communicating hole is aligned with the inlet waterway, and the second outlet waterway is communicating with the inlet waterway when the communicating hole is hermetically stagger with inlet waterway.

In a preferred embodiment, wherein, the fixing piece comprises:

A body, which is provided with:

A concavely arranged outlet cavity, which is communicated with the second outlet waterway, and a plurality of water division holes the number of which is equal to the water division cavities with check valve are opened on the undersurface of the outlet cavity, and the water division holes are communicated with the outlet holes respectively;

A switch plate, in which a penetrating hole penetrating up and down and corresponding to the water division holes is arranged, and the switch plate is hermetically mounted above the undersurface of the outlet cavity in a rotating manner;

An impeller, which is connected to the switch plate in a transmission manner, and is pivotally connected in the outlet cavity, and can rotate with respect to the main body unit under the impact of the water flow from the second outlet waterway, and the rotation of the impeller can drive the rotation of the switch plate, so that the penetrating hole can be communicated with a plurality of the water division holes in a switch manner;

And a handle, which is fixed to the body, and is provided with the said inlet waterway.

In a preferred embodiment, the switch mechanism also comprises an assembling hole opened on the body and communicating with the inlet waterway, a spring and a leather cup that is against the spring are mounted in the assembling hole, and the leather cup is tightly against above the waterproof plate, the communicating hole is communicating with the inlet waterway when the communicating hole is aligned with the assembling hole, and the second outlet waterway is communicating with the inlet waterway when the communicating hole is hermetically stagger with the assembling hole.

Compared with the technical proposal at the prior, the benefits of the present invention are:

1 When water comes out of the first outlet waterway, the check valves are open, and then water flows into the water division cavities with the check valve, and then water comes out of the water division cavities with check valve and the water division cavities without check valve with big outlet area; when water comes out of the second outlet waterway, the check valves are closed, and water comes out of the corresponding water division cavities controlled by the control mechanism, the users can choose between the large outlet area and the small outlet area, the performance is good;

2 the control mechanism comprises the outlet cavity, the switch plate and the impeller, the impeller can rotate with respect to the main body unit under the impact of the water flow from the second outlet waterway, and the rotation of the impeller can drive the rotation of the switch plate, so that the penetrating hole can be communicated with a plurality of the water division holes in a switch manner, and water comes out of a plurality of the water division cavities in turn, and the dancing spray can be generated with good massage effect;

3 a reducing mechanism is connected between the impeller and the switch plate with obvious dancing spray effect;

4 the reducing mechanism is the differential gear mechanism with simple structure, small space occupation and compact structure;

5 the diameter of the circle of the mounting holes is larger than the diameter of the circle of the outlet holes, the check valves and the outlet holes are separated, so that it is easy for the users to design the first outlet waterway, the second outlet waterway, the switch mechanism and the control mechanism;

6 the waterproof plate is fixed on the water division plate of the outlet terminal to form a circular first outlet waterway corresponding to the check valves, the layout is clever, and the structure is compact.

BRIEF DESCRIPTION OF THE DRAWINGS

With the following description of the drawings and specific embodiments, the invention shall be further described in details.

DESCRIPTION OF THE PREFERRED EMBODIMENTS

According to FIGS. 1 to 5, the multi function outlet mechanism in the present preferred embodiment comprises a main body unit, a switch mechanism and a control mechanism, and the outlet mechanism is a shower.

The main body unit comprises an outlet terminal 100, a waterproof plate 200, a body 300 and a handle 400.

Figure 1:
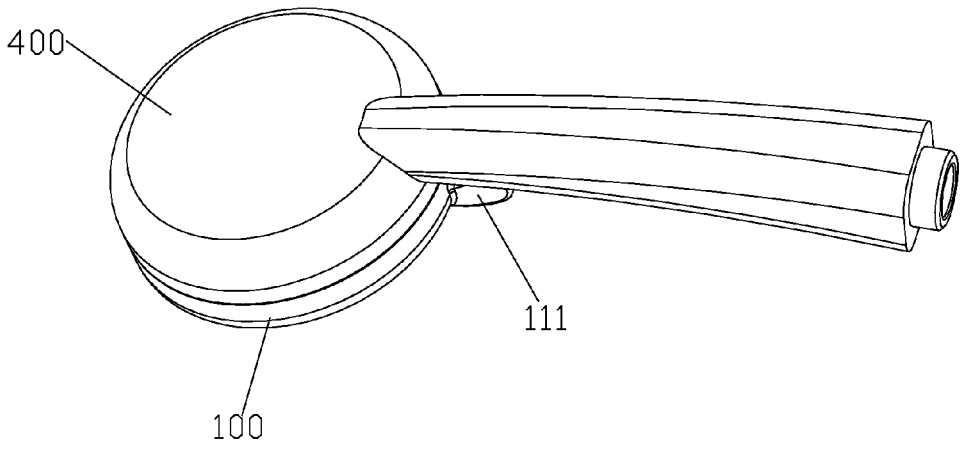
FIG. 1 shows the solid view of the multi function outlet mechanism of the preferred embodiment in the present invention.
Figure 2:
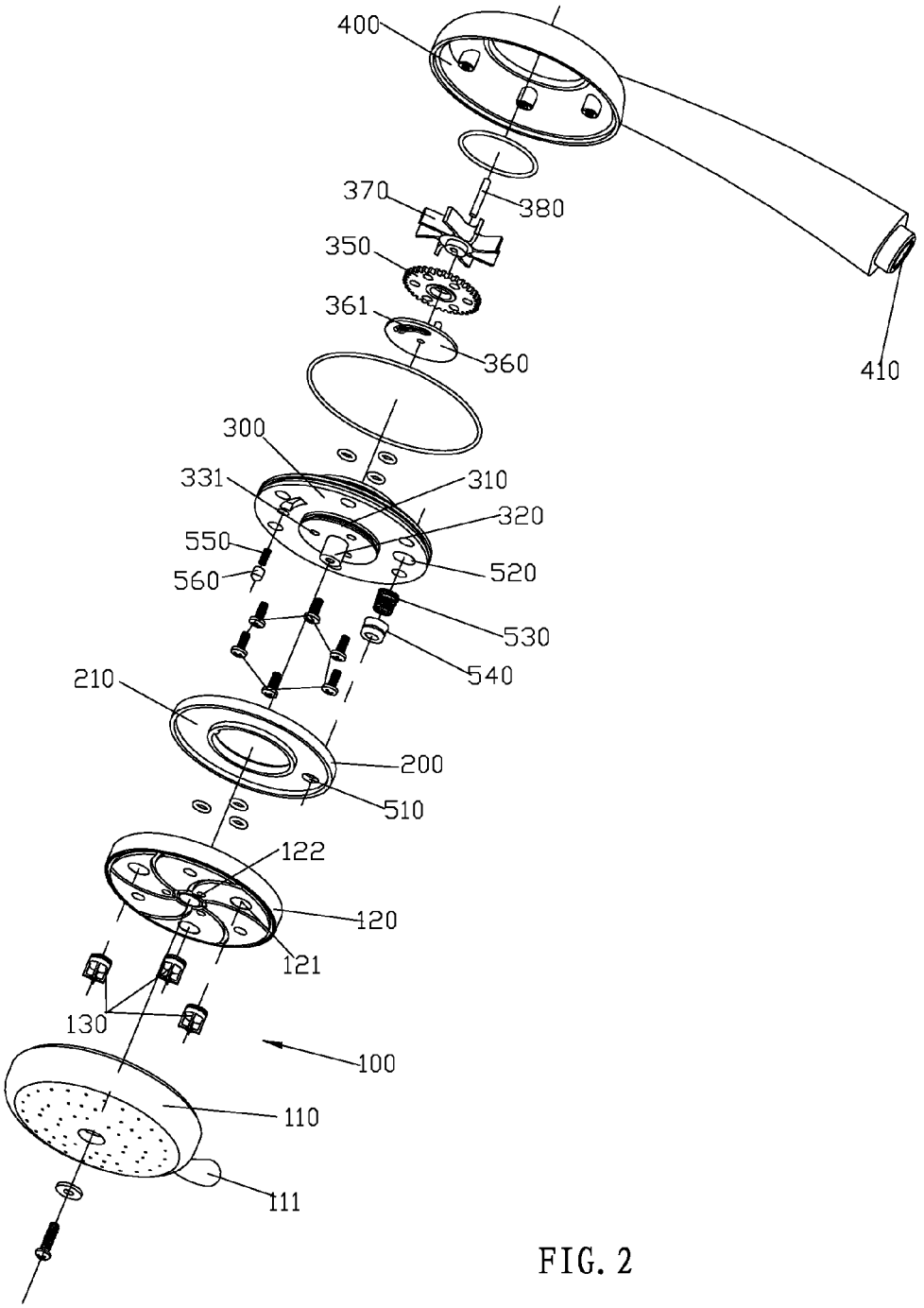
FIG. 2 shows one of the solid exploded view of the multi function outlet mechanism of the preferred embodiment in the present invention.
Figure 3:
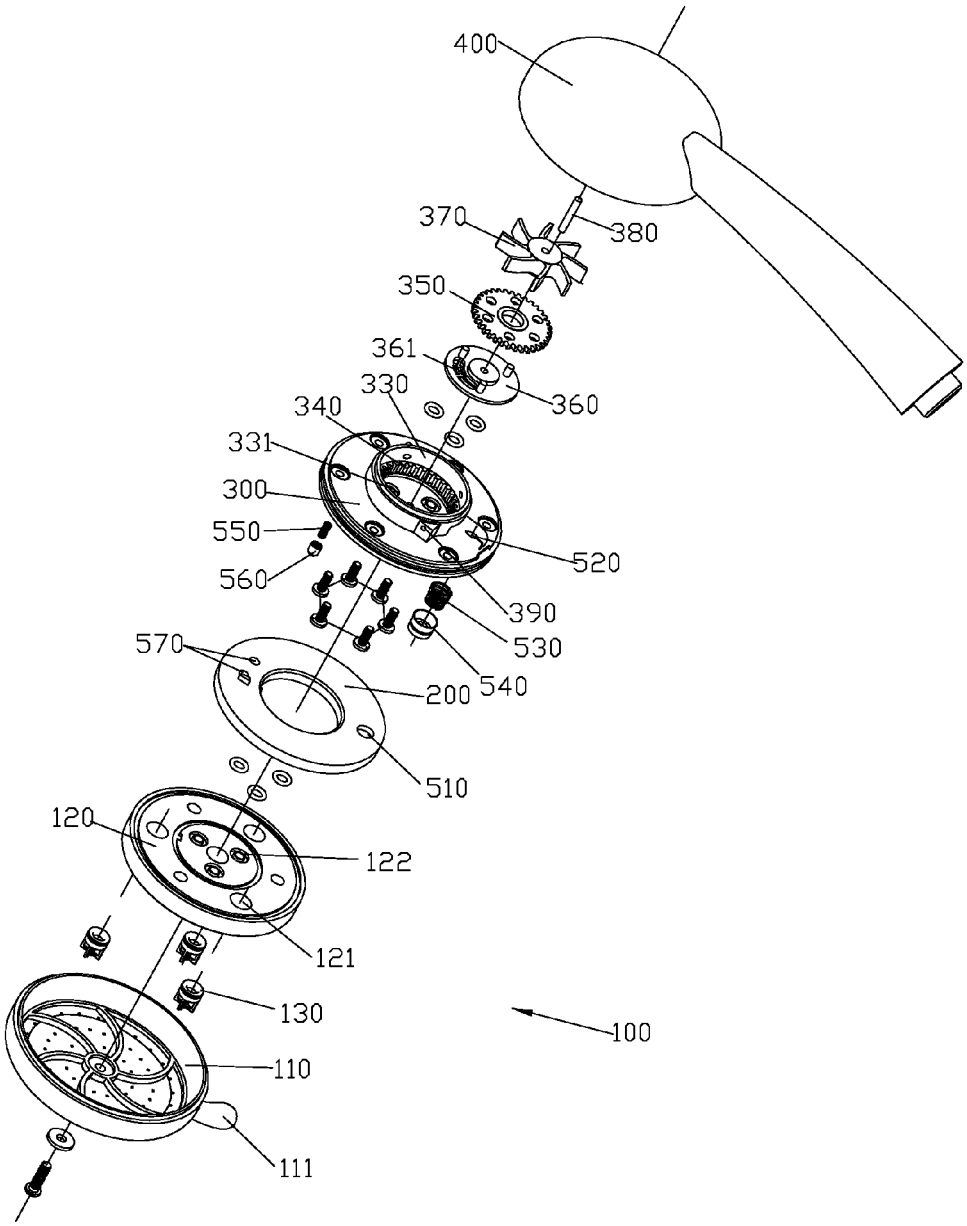
FIG. 3 shows another solid exploded view of the multi function outlet mechanism of the preferred embodiment in the present invention.
Figure 5:
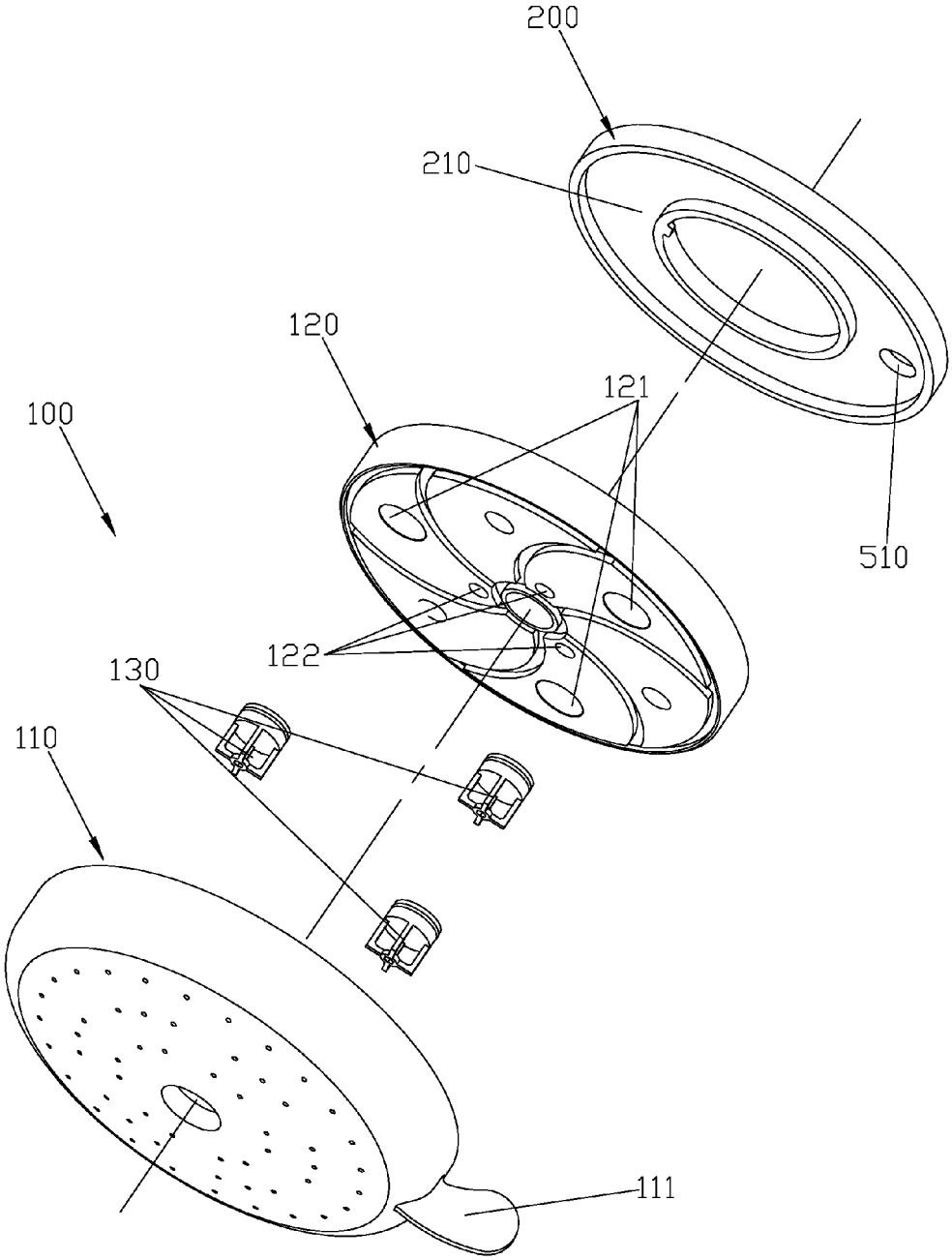
FIG. 5 shows the coupling view of the face cover, the check valve, the water division disc, and the waterproof plate of the multi function outlet mechanism of the preferred embodiment in the present invention.

According to FIGS. 2, 3 and 5, the outlet terminal 100 comprises a face cover 110 and a water division plate 120, the face cove 110 and the water division plate 120 are fixed together and forms six independent water division cavities 140, but the number of the water division cavities 140 is not limited in the present invention, four or five is also ok. The mounting holes 121 arranged in a circle are arranged on the water division plate 120, the number of which is equal to the water division cavities 140 with check valve, a check valve 130 is arranged in the mounting hole 121, and in the present embodiment, a check valve 130 is arranged in each of the water division cavities 140, the said multi check valves 130 are corresponding to and communicating with the water division cavities 140 respectively, but it is not limited, only two water division cavities 140 are provided with check valve according to needs; the outlet holes 122 arranged in a circle are arranged on the water division plate 120, the number of which is equal to the water division cavities 140 with check valve, the said multi outlet holes 122 are corresponding to and communicating with the water division cavities 140 respectively. Furthermore, the diameter of the circle of the mounting holes 121 is larger than the diameter of the circle of the outlet holes 122. It is better that a hand knob 111 is arranged out of the face cover 110 for force control of the users.

The waterproof plate 200 is a ring form, and it comprises a ring plate, an inner surrounding wall extending downward from the inner periphery of the ring plate and an outer surrounding wall extending downward from the outer periphery of the ring plate. The waterproof plate 200 is fixed above the water division plate 120 of the outlet terminal 100 and forms the circular first outlet waterway 210 corresponding to the check valve; the outlet holes 122 of the water division plate 120 is located in the inner bore of the waterproof plate 200, namely in the inner surrounding wall.

Figure 4:
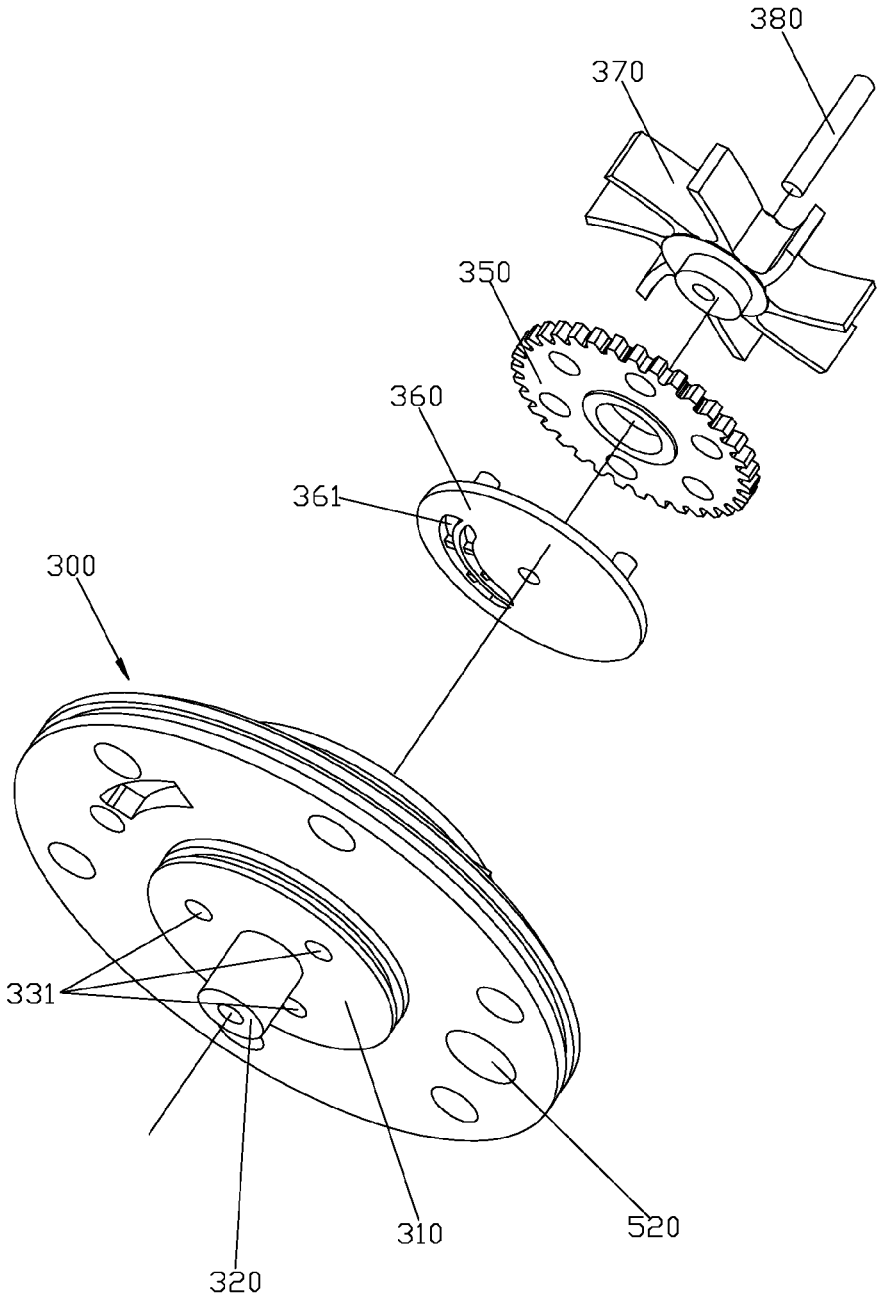
FIG. 4 shows the coupling view of the body, the switch plate, the gear, the impeller and the shaft of the multi function outlet mechanism of the is preferred embodiment in the present invention.

According to FIGS. 2, 3 and 4, the body 300 and the handle 400 are fixed together and form an inlet waterway 410 communicating with the outer water resource and a second outlet waterway 390.

A rounded boss 310 is convexly arranged at the central part of the undersurface of the body 300, and a rounded convex shaft 320 is arranged at the central part of the under surface of the rounded boss 310. An outlet cavity 330 is concavely arranged on the top surface of the body 300, and the water division holes 331 are opened on the undersurface of the outlet cavity 330, the number of which is equal to the water division cavities 140 with check valve. An inner gear 340, an outer gear 350, a switch plate 360 and an impeller 370 are arranged on the outlet cavity 330, and the inner gear 340 is pivotally arranged on the outlet cavity 330, and the outer gear 350, the switch plate 360 and the impeller 370 arranged in the outlet cavity 330 through the shaft 380. The impeller 370 can be rotated by the impact from the second outlet waterway 390, and it is better that the second inlet waterway 390 comprises the oblique hole of the inlet waterway 410 arranged on the body 300. The rotation of the impeller 370 can drive the outer gear 350 move. The outer gear 350 is engaged with the inner gear 340, and the movement is transmitted to the switch plate 360, and then 360 rotates around 380. In the present embodiment, the number of the teeth of the inner gear 340 is more than that of the outer gear 350 to form differential gear reducer structure. The outer gear 350 and the switch plate 360 are coaxially fixed together. The penetrating holes 361 penetrating up and down and corresponding to the water division holes are arranged on the switch plate 360, and switch plate 360 is mounted on the undersurface of the outlet cavity 330 in a sealing and rotating manner. Wherein, the impeller 370 is impacted by the water flow and rotates, and then the outer gear 350 is driven to rotate, and 350 is meshed with the inner gear 340, and then the switch plate 360 is driven to rotate, so that a plurality of the water division holes are switched to communicate with the penetrating hole 361 in turn. The outlet cavity 330, the inner gear 340, the outer gear 350, the switch plate 360 and the impeller 370 are coupling together to form the control mechanism.

The rounded boss 310 of the body 300 passes through the inner hole of the waterproof plate 200 in a sealing and rotating manner, the rounded convex shaft 320 is spliced into the outlet terminal 100 in a sealing and rotating manner, so that the outlet terminal 100 can rotate with respect to the handle and the body, and then the said water division holes 331 can be communicated with the outlet holes 122 respectively.

The switch mechanism comprises a communicating hole 510 opened on the waterproof plate 200 and communicating with the first outlet waterway 210 and a assembling hole 520 opened on the body 300 and communicating with the inlet waterway 410, a spring 530 and a leather cup 540 that is against the spring 530 are mounted in the assembling hole 520, and the leather cup 540 is tightly secured against and above the waterproof plate 200, the communicating hole 510 is communicating with the inlet waterway 410 when the communicating hole 510 is aligned with the assembling hole 520, and the second outlet waterway is communicating with the inlet waterway 410 when the communicating hole 510 is hermetically stagger with the assembling hole 520.

According to needs, the switch mechanism also comprises a locating mechanism that comprises an elastic piece 550 arranged at the body, a locating pillar 560 connecting and against the elastic piece 550 and two locating holes 570 arranged at the waterproof plate 200, and the locating pillar 560 is coupling with any of the locating holes 570.

In the present embodiment, the outlet cavity, the switch plate and the impeller are coupling together to form the control mechanism.

Figure 6:
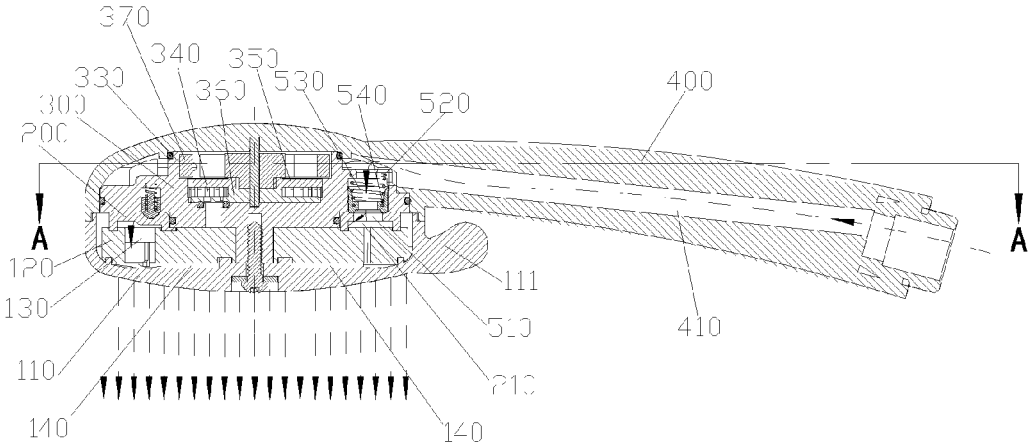
FIG. 6 shows the sectional view of the multi function outlet mechanism of the preferred embodiment in the present invention, water flows into the first outlet waterway of the multi function outlet mechanism.
Figure 7:
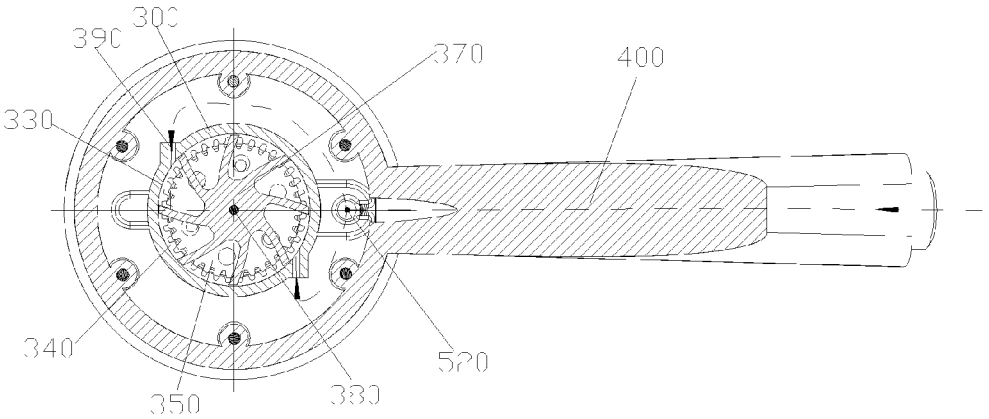
FIG. 7 shows the sectional view of FIG. 6 A-A.

According to FIGS. 6 and 7, the communicating hole 510 is communicating with the inlet waterway 410 when the communicating hole 510 is aligned with the assembling hole 520, and water flows into the first outlet waterway 210, and the check valves 130 are opened, and then water flows into the water division cavities 140, and then water flows out of the all water division cavities 140, and then water comes out of the outlet face cover; a little water flows into the second outlet waterway at this moment, but the water pressure is not enough to pull the impeller, and the water outlet is not affected.

Figure 8:
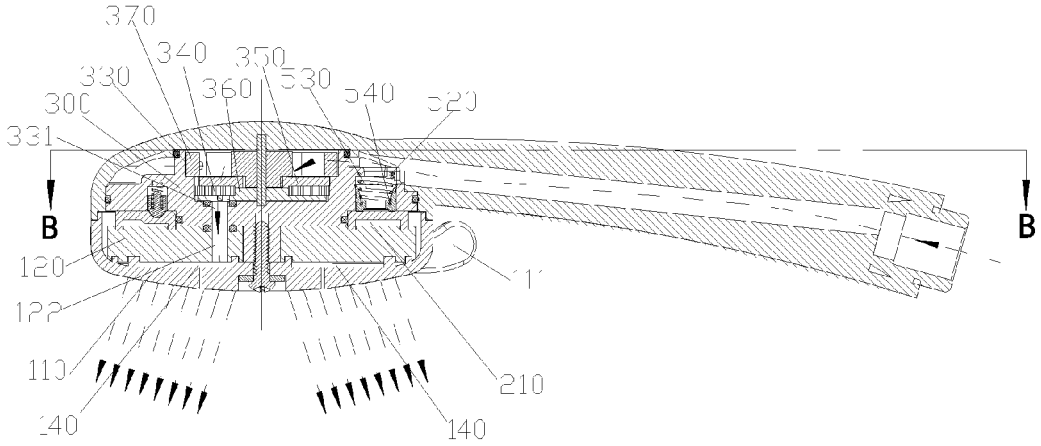
FIG. 8 shows the sectional view of the multi function outlet mechanism of the preferred embodiment in the present invention, water flows into the second outlet waterway of the multi function outlet mechanism.
Figure 9:
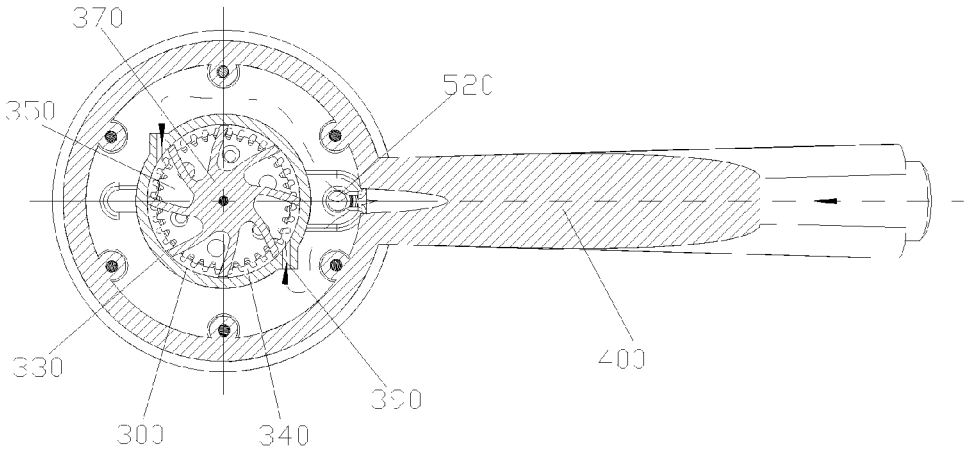
FIG. 9 shows the sectional view of FIG. 8 B-B.

According to FIGS. 8 and 9, the outlet terminal is rotated, the communicating hole 510 is hermetically stagger with the assembling hole 520, all the water comes into the second outlet waterway 390, the water flow impacts the impeller, and then water flows out of different water division cavities 140 in turn, and the dancing spray is generated at the face cover.

In another preferred embodiment, the control mechanism is the one comprises a switch plate and a controller which is controlled by the users and is connected with the switch plate in a transmission manner and extends out of the main body unit, the users can control the rotation of the switch plate with respect to the main body unit through the controller, and the manual control of that water comes out of different water division cavities 140 is achieved.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The multi function outlet mechanism, its switch mechanism and control mechanism are mounted in the main body unit, the users can use the switch mechanism to control at least the first outlet waterway and the second outlet waterway communicating with the inlet waterway in a switching manner, and the control mechanism is used for communicating multi water division cavities with the second outlet waterway in a switching manner. When water comes out of the first outlet waterway, the check valves are open, and then water flows into the water division cavities with the check valve, and then water comes out of the water division cavities with check valve and the water division cavities without check valve with big outlet area; when water comes out of the second outlet waterway, the check valves are closed, and water comes out of the corresponding water division cavities controlled by the control mechanism.

What is claimed is:

1. A multi function outlet mechanism, comprising:

a main body unit provided with an inlet waterway, a first outlet waterway, a second outlet waterway and an outlet terminal, the outlet terminal is provided with a plurality of water division cavities, and the main body unit includes check valves arranged in at least two of the water division cavities, and the first outlet waterway is communicated with the check valves, when a water pressure of the first outlet waterway is bigger than the a control water pressure of the check valves, the check valves are opened so that water flows into the water division cavities from the first outlet waterway, when water flows in the second outlet waterway the check valves are closed;

a switch mechanism, mounted to the main body unit so that the a user can use the switch mechanism to control at least one of the first outlet waterway and the second outlet waterway to communicate with the inlet waterway in a switching manner; and a control mechanism mounted at the main body unit, so that the second outlet waterway is communicable with the plurality of the water division cavities in a switching manner.

2. The multi function outlet mechanism according to claim 1, wherein the switch mechanism is a rotary switch mechanism.

3. A multi function outlet mechanism, comprising:

a main body unit provided with an inlet waterway, a first outlet waterway, a second outlet waterway and an outlet terminal, the outlet terminal is provided with a plurality of water division cavities, and the main body unit includes check valves arranged in at least two of the water division cavities, and the first outlet waterway is communicated with the check valves, when a water pressure of the first outlet waterway is bigger than a control water pressure of the check valves, the check valves are opened so that water flows into the water division cavities from the first outlet waterway;

a switch mechanism, mounted to the main body unit so that a user can use the switch mechanism to control at least one of the first outlet waterway and the second outlet waterway to communicate with the inlet waterway in a switching manner; and a control mechanism mounted at the main body unit, so that the second outlet waterway is communicable with a plurality of the water division cavities in a switching manner, wherein the control mechanism comprises:

an outlet cavity, which is communicated with the second outlet waterway, and water division holes are arranged on an undersurface of the outlet cavity, a number of the water division holes is equal to a number of the water division cavities that each has one of the check valves, and the water division holes and the water division cavities are communicating respectively;

a switch plate, in which a penetrating hole corresponding to the water division holes and penetrating in an up and down direction is arranged, and the switch plate is mounted on the undersurface of the outlet cavity in a sealing and rotating manner; and And an impeller connected to the switch plate in a transmission manner, and is pivotally connected in the outlet cavity and is rotatable with respect to the main body unit under an impact of a water flow of the second outlet waterway, and the impeller can drive the switch plate to rotate, and the penetrating hole can communicate with a plurality of the water division holes in a switching manner.

4. The multi function outlet mechanism according to claim 3, further comprising a reducing mechanism connected between the impeller and the switch plate.

5. The multi function outlet mechanism according to claim 4, wherein the reducing mechanism comprises:

an inner gear arranged in the outlet cavity; and an outer gear arranged in the outlet cavity in a rotating manner, the inner gear is meshed with the outer gear, and a number of teeth of the inner gear is different from that of the outer gear, and a synchronous rotary connection relationship is formed between the outer gear and the impeller and between the outer gear and the switch plate.

6. A multi function outlet mechanism, comprising:

a main body unit provided with an inlet waterway, a first outlet waterway, a second outlet waterway and an outlet terminal, the outlet terminal is provided with a plurality of water division cavities, and the main body unit includes check valves arranged in at least two of the water division cavities, and the first outlet waterway is communicated with the check valves, when a water pressure of the first outlet waterway is bigger than a control water pressure of the check valves, the check valves are opened so that water flows into the water division cavities from the first outlet waterway;

a switch mechanism, mounted to the main body unit so that a user can use the switch mechanism to control at least one of the first outlet waterway and the second outlet waterway to communicate with the inlet waterway in a switching manner; and a control mechanism mounted at the main body unit, so that the second outlet waterway is communicable with a plurality of the water division cavities in a switching manner, wherein the outlet terminal comprises:

a face cover; and a water division plate, the face cover and the water division plate are fixed together to form the water division cavities to be independent, wherein mounting holes are arranged in a circle on the water division plate, a number of the mounting holes is equal to a number of the water division cavities that each has one of the check valves, the mounting holes are used for mounting the check valves;

further wherein outlet holes are arranged in a circle on the water division plate, a number of the outlet holes is equal to the number of the water division cavities that each has one of the check valves, the diameter of the circle of the mounting holes is larger than the diameter of the circle of the outlet holes.

7. The multi function outlet mechanism according to claim 6, wherein the control mechanism is used for communicating a plurality of the outlet holes with the second outlet waterway in a switching manner.

8. The multi function outlet mechanism according to 7, wherein the main body unit further comprises:

a circular waterproof plate; and a fixing piece, the outlet terminal is connected to the fixing piece in a rotating manner, wherein the waterproof plate is fixed on the water division plate of the outlet terminal to form the first outlet waterway which is circular and corresponds to the check valves;

the outlet holes of the water division plate are located in an inner bore of the waterproof plate;

the switch mechanism comprises a communicating hole that is opened on the waterproof plate and communicating with the first outlet waterway, the communicating hole communicates with the inlet waterway when the communicating hole is aligned with the inlet waterway, and the second outlet waterway communicates with the inlet waterway when the communicating hole is hermetically staggered with inlet waterway.

9. The multi function outlet mechanism according to claim 8, wherein, the fixing piece comprises:

a body provided with a concavely arranged outlet cavity, which is communicated with the second outlet waterway, and a plurality of water division holes having a number equal to a number of the water division cavities that each has one of the check valves, the water division holes are opened on an undersurface of the outlet cavity, and the water division holes being communicated with the outlet holes respectively;

a switch plate, in which a penetrating hole is arranged to penetrate in an up and down direction and corresponding to the water division holes, and the switch plate is hermetically mounted above the undersurface of the outlet cavity in a rotating manner; and an impeller connected to the switch plate in a transmission manner, and is pivotally connected in the outlet cavity, and is rotatable with respect to the main body unit under an impact of a water flow from the second outlet waterway, and the rotation of the impeller can drive rotation of the switch plate, so that the penetrating hole is communicable with a plurality of the water division holes in a switching manner.

10. The multi function outlet mechanism according to claim 9, wherein, the switch mechanism further comprises:

an assembling hole opened on the body and communicating with the inlet waterway;

a spring; and a leather cup that is against the spring, wherein the spring and leather cup are mounted in the assembling hole, and the leather cup is tightly placed against and above the waterproof plate, further wherein the communicating hole communicates with the inlet waterway when the communicating hole is aligned with the assembling hole, and the second outlet waterway communicates with the inlet waterway when the communicating hole is hermetically staggered with the assembling hole.

11. The multi function outlet mechanism according to claim 6, wherein the main body unit further comprises:

a circular waterproof plate; and a fixing piece, the outlet terminal is connected to the fixing piece in a rotating manner, wherein the waterproof plate is fixed on the water division plate of the outlet terminal to form the first outlet waterway which is circular and corresponds to the check valves;

the outlet holes of the water division plate are located in an inner bore of the waterproof plate;

the switch mechanism comprises a communicating hole that is opened on the waterproof plate and communicating with the first outlet waterway, the communicating hole communicating with the inlet waterway when the communicating hole is aligned with the inlet waterway, and the second outlet waterway communicating with the inlet waterway when the communicating hole is hermetically staggered with the inlet waterway.

12. The multi function outlet mechanism according to claim 11, wherein, the fixing piece comprises:

a body provided with a concavely arranged outlet cavity, which is communicated with the second outlet waterway, and a plurality of water division holes having a number equal to a number of the water division cavities that each has one of the check valves, the water division holes are opened on an undersurface of the outlet cavity, and the water division holes being communicated with the outlet holes respectively;

a switch plate, in which a penetrating hole is arranged to penetrate in an up and down direction and corresponding to the water division holes, and the switch plate is hermetically mounted above the undersurface of the outlet cavity in a rotating manner; and an impeller connected to the switch plate in a transmission manner, and is pivotally connected in the outlet cavity, and is rotatable with respect to the main body unit under an impact of a water flow from the second outlet waterway, and the rotation of the impeller can drive rotation of the switch plate, so that the penetrating hole is communicable with a plurality of the water division holes in a switching manner; and a handle fixed to the body, and provided with the inlet waterway.

13. The multi function outlet mechanism according to claim 12, wherein, the switch mechanism further comprises:

an assembling hole opened on the body and communicating with the inlet waterway;

a spring; and a leather cup that is against the spring, wherein the spring and the leather cup are mounted in the assembling hole, and the leather cup is tightly placed against and above the waterproof plate, further wherein the communicating hole communicates with the inlet waterway when the communicating hole is aligned with the assembling hole, and the second outlet waterway communicates with the inlet waterway when the communicating hole is hermetically staggered with the assembling hole.

* * * * *